US011493239B2

(12) United States Patent
Tunkel et al.

(10) Patent No.: US 11,493,239 B2
(45) Date of Patent: Nov. 8, 2022

(54) METHOD FOR REDUCING THE ENERGY NECESSARY FOR COOLING NATURAL GAS INTO LIQUID NATURAL GAS USING A NON-FREEZING VORTEX TUBE AS A PRECOOLING DEVICE

(71) Applicant: Universal Vortex, Inc., Princeton Junction, NJ (US)

(72) Inventors: Lev Tunkel, Princeton, NJ (US); Ross Gale, Pennington, NJ (US)

(73) Assignee: Universal Vortex, Inc., Princeton Junction, NJ (US)

( * ) Notice: Subject to any disclaimer, the term of this patent is extended or adjusted under 35 U.S.C. 154(b) by 435 days.

(21) Appl. No.: 16/588,697

(22) Filed: Sep. 30, 2019

(65) Prior Publication Data

US 2020/0103146 A1 Apr. 2, 2020

Related U.S. Application Data

(60) Provisional application No. 62/738,553, filed on Sep. 28, 2018.

(51) Int. Cl.

| | |
|---|---|
| ***F25B 9/04*** | (2006.01) |
| ***F25J 3/06*** | (2006.01) |
| ***E21B 43/34*** | (2006.01) |

(52) U.S. Cl.

CPC ..... *F25B 9/04* (2013.01); *F25J 3/0615* (2013.01); *E21B 43/34* (2013.01); *F25B 2400/23* (2013.01)

(58) Field of Classification Search

CPC ..... F25B 9/04; F25B 2400/23; F25J 3/0615; F25J 1/0232; F25J 2205/10; F25J 2210/06; E21B 43/34

(Continued)

(56) References Cited

U.S. PATENT DOCUMENTS 3,892,070 A 7/1975 Bose
4,612,646 A 9/1986 Zerr (Continued)

FOREIGN PATENT DOCUMENTS

RU 939115500.7 11/1995

OTHER PUBLICATIONS

Hilsch, R., THe Use of the Expansion Gases in a Centrifugal Field as Cooling Process, Oct. 10, 1946, The Review of Scientific Instruments, vol. 18, No. 2. (Year: 1946).*

(Continued)

*Primary Examiner* — Steve S Tanenbaum
(74) *Attorney, Agent, or Firm* — Sterne, Kessler, Goldstein & Fox P.L.L.C.

(57) ABSTRACT

A method for efficiently reducing the energy required to convert natural gas from a natural gas pressure letdown facility at high pressure and pipeline/wellhead temperature to liquid natural gas in close proximity to/collocation with a natural gas pressure letdown/regulation facility using Non-Freezing Vortex Tubes (U.S. Pat. No. 5,749,231) in arrangement with indirect contact heat exchangers. The Non-Freezing Vortex Tubes separate the inlet natural gas into hot flow and cold flow outlet natural gas flows. One portion of the natural gas flow from the high-pressure transmission line/gas wellhead is directed through the Non-Freezing Vortex Tube and the cold outlet flow of the natural gas is directed to the indirect contact heat exchanger(s) to act as the cooling medium. The liquid natural gas plant's required natural gas flow is directed at the existing pipeline/wellhead gas pressure through the heat exchanger and cooled. The already cooled natural gas flow is directed to a turbo expander and refrigeration cold box system where it is further chilled and converted into liquid natural gas at −162° C.

17 Claims, 4 Drawing Sheets

(58) Field of Classification Search
USPC ..... 62/5
See application file for complete search history.

(56) References Cited

U.S. PATENT DOCUMENTS

| | | | | |
|---|---|---|---|---|
| 5,193,341 | A | 3/1993 | Sibbertsen et al. | |
| 5,344,478 | A | 9/1994 | Zurecki et al. | |
| 5,582,012 | A * | 12/1996 | Tunkel | F25B 9/04 62/5 |
| 5,749,231 | A | 5/1998 | Tunkel | |
| 5,911,740 | A | 6/1999 | Tunkel | |
| 5,937,654 | A | 8/1999 | Tunkel | |
| 6,289,679 | B1 | 9/2001 | Tunkel | |
| 6,379,411 | B1 | 4/2002 | Turner et al. | |
| 6,442,947 | B1 | 9/2002 | Mitchell | |
| 6,962,199 | B1 | 11/2005 | Tjeenk | |
| 7,565,808 | B2 | 7/2009 | Sullivan | |
| 7,654,095 | B2 | 2/2010 | Sullivan | |
| 9,707,620 | B2 | 7/2017 | Zhu et al. | |
| 9,797,659 | B2 | 10/2017 | Wan et al. | |
| 2002/0194988 | A1 | 12/2002 | Betting et al. | |
| 2006/0163054 | A1 | 7/2006 | Spitzl | |
| 2006/0230765 | A1 | 10/2006 | Fedorov et al. | |
| 2008/0133110 | A1 | 6/2008 | Vetrovec | |
| 2010/0132818 | A1 | 6/2010 | Dell et al. | |
| 2010/0139292 | A1 | 6/2010 | Grand et al. | |
| 2013/0067905 | A1 | 3/2013 | Eckert | |
| 2013/0186132 | A1 * | 7/2013 | Banszky | F25J 3/064 62/618 |
| 2017/0131027 | A1 * | 5/2017 | Mak | F25J 1/0285 |
| 2017/0151511 | A1 | 6/2017 | Lu | |
| 2017/0185113 | A1 | 6/2017 | Wang | |
| 2017/0303433 | A1 | 10/2017 | Delano et al. | |
| 2018/0259227 | A1 | 9/2018 | Tunkel | |

OTHER PUBLICATIONS

Office Action dated May 30, 2019 in U.S. Appl. No. 15/975,951.
Office Action dated Nov. 1, 2018 in U.S. Appl. No. 15/975,951.
Office Action dated Dec. 14, 2017 in U.S. Appl. No. 14/559,334.
Office Action dated Jun. 30, 2017 in U.S. Appl. No. 14/559,334.

* cited by examiner

METHOD FOR REDUCING THE ENERGY NECESSARY FOR COOLING NATURAL GAS INTO LIQUID NATURAL GAS USING A NON-FREEZING VORTEX TUBE AS A PRECOOLING DEVICE

PRIORITY

This application claims priority to Provisional Application 62/738,553 filed on Sep. 28, 2018.

BACKGROUND OF INVENTION

The present invention addresses liquid natural gas (LNG) production in the proximity of or collocated with a gas pressure letdown facility (i.e., City Gate, wellhead, etc.) and claims the method of using the Non-Freezing Vortex Tube (U.S. Pat. No. 5,749,231, Tunkel, L.) to substantially reduce the energy consumption of the process by reducing the temperature of natural gas being fed to a liquid natural gas plant.

Natural gas conversion into LNG takes place at gas temperature of −260° F. (−162° C.) and pressure of approximately 4 prig (0.28 Bar). The conventional process (shown in FIG. 1) of liquefaction includes raw material feed gas (pipeline, wellhead, or other high pressure gas, typically, at 40° F.-60° F.) (001) drying to a low dew point (stripping all natural gas liquids/hydrates) (002), followed by deep chilling, generally using a turbo expander and a cold box/cryogenic refrigeration unit(s) (003) where the liquefaction temperature is reached. This process, is energy intensive and the equipment is expensive from both a capital expense and operating expense perspective, with a significant environmental footprint as a result of the energy consumption.

The large energy consumption associated with LNG production can be substantially reduced by placing an LNG plant in close proximity to a pressure letdown facility and utilizing the available cooling load (Joule-Thomson temperature drop of the pressure regulated main pipeline gas flow/wellhead gas) to precool high pressure LNG feed gas upstream of the conventional liquefaction process. Conventionally, the practical application of this cooling load is complicated by the possibility of depressurized gas freeze up. This is addressed by applying the Non-Freezing Vortex Tube (U.S. Pat. No. 5,749,231, Tunkel, L.) as a primary pressure regulator of a portion of the high-pressure main transmission gas flow on the pipeline (without interrupting any of the LNG plant's raw material feed gas flow rate/volume and pressure). The Non-Freezing Vortex Tube set up in parallel with a pressure reducing line of a letdown facility operates under the available pressure differential of the non-regulated and regulated gas pressures. This is the driving force of the Non-Freezing Vortex Tube. The Non-Freezing Vortex Tube configured as dual stream (hot and cold outlet unit) chills LNG feed in an indirect contact heat exchanger (shell and tube style) by the vortex tube cold outlet flow with the temperature reduced by the combined Joule-Thomson and Vortex phenomenon. After the heat exchanger, the Vortex Tube low pressure hot and cold outlet streams are recombined and injected back into the gas pipeline network downstream of the pressure letdown facility, circumventing the traditional preheat/reduction process.

The present invention improves the efficiency of the LNG manufacturing process, applying a chilling (precooling) effect to the LNG feed gas with a completely free cooling load in the form of cooling energy generated in the Non-Freeze Vortex Tube's cold outlet flow during the course of routine pressure regulation of pipeline or wellhead gas using the available pressure letdown facility's high pressure input and low pressure output. This cold energy provided by the cold outlet of the Non-Freezing Vortex Tube is used to reduce the inlet temperature of the natural gas prior to the deep chilling/liquefaction of the feed gas in a turbo-expander and cold box. Specifically, the Non-Freeze Vortex Tube is fed by high pressure natural gas at pipeline/wellhead gas temperature. In the Non-Freezing Vortex Tube, the gas is separated into hot and cold segments at the vortex tube outlets without the use of any external energy source. See. U.S. Pat. No. 5,749,231. The cold outlet flow of the Non-Freezing Vortex Tube is sent to an indirect contact heat exchanger where it operates to cool the separate and distinct flow of high-pressure natural gas from the transmission line or wellhead that feeds into a turbo expander and subsequently the cold box. The result is a lower gas inlet temperature at the inlet of the LNG plant, achieved without the use of any external energy source, which results in less energy use in the liquefaction/refrigeration process to reduce the natural gas temperature to −162° C. where the gas becomes liquid natural gas (LNG).

BRIEF SUMMARY OF INVENTION

The present invention discloses several preferred embodiments of a method to minimize the external energy requirement for converting natural gas into LNG at an LNG plant located in proximity of or collocation with a natural gas pressure letdown facility (e.g., pipeline pressure regulation station or natural gas wellhead). Specifically, in a preferred embodiment, a method is disclosed whereby Non-Freezing Vortex Tubes (U.S. Pat. No. 5,749,231) with cold and hot side outlet operating under the available pressure differential at the letdown facility and fed by a portion of said facility's gas flow are arranged to feed indirect contact shell and tube style (or other indirect contact) heat exchangers. These heat exchangers work to reduce the temperature of the separate high-pressure natural gas, thus reducing the amount of energy needed to convert the gas into liquid form as compared with the prior art process shown in FIG. 1.

DRAWINGS

DETAILED DESCRIPTION OF INVENTION

Figure 1:
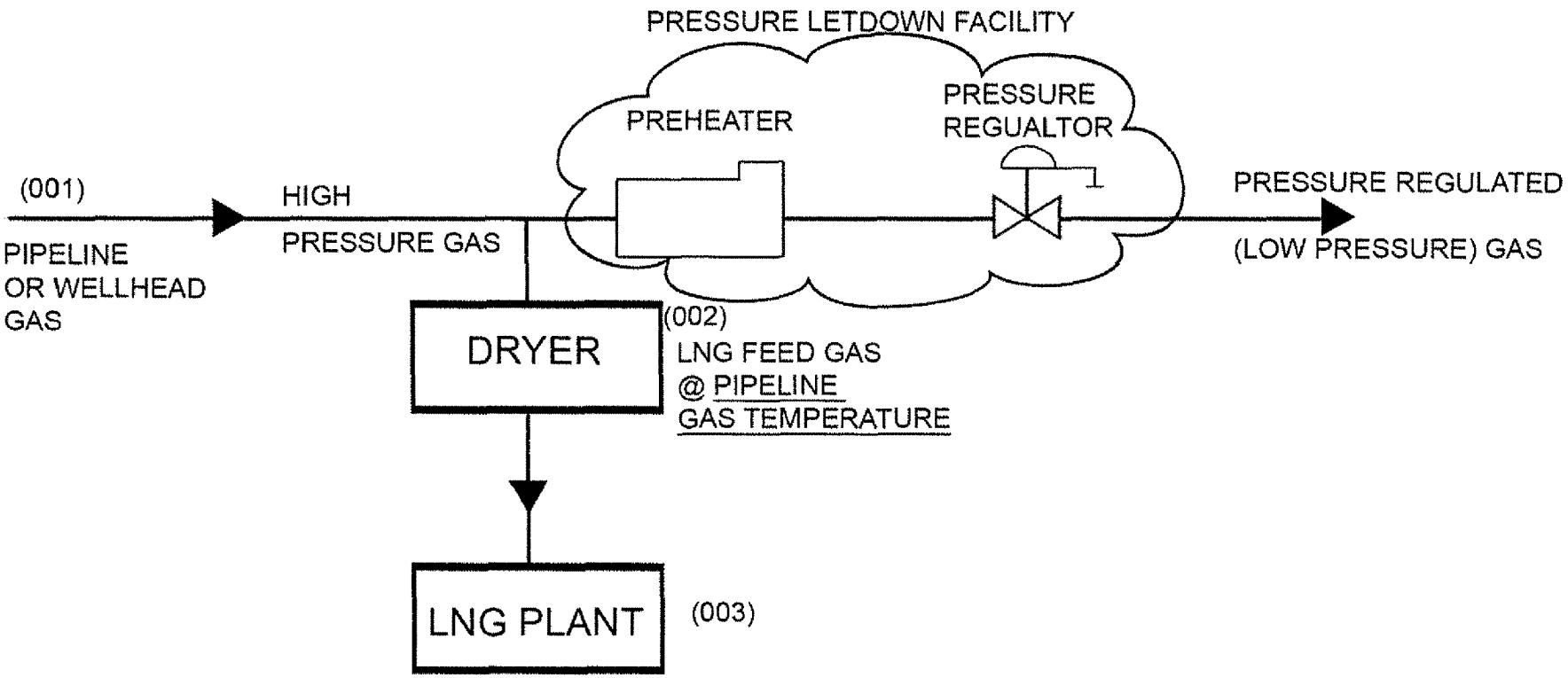
FIGURE 1 Prior Art
FIG. 1 is a depiction of the prior art.

The present invention will now be described in terms of the presently preferred embodiment thereof as illustrated in the drawings. Those of ordinary skill in the art will recognize that many obvious modifications may be made thereto without departing from the spirit or scope of the present invention.

The invention is associated with the operation of a natural gas pressure letdown facility (e.g., city gate station, district regulation station, or wellhead where formation gas is depressurized in a choke) where natural gas at high pressure is "letdown" to lower pressures. Upstream of a pressure letdown facility, a liquid natural gas ("LNG") plant can be installed to utilize natural gas at a higher pressure to increase flow rate and increase the pressure differential between inlet and liquefaction pressure to achieve free cooling duty.

Figure 2:
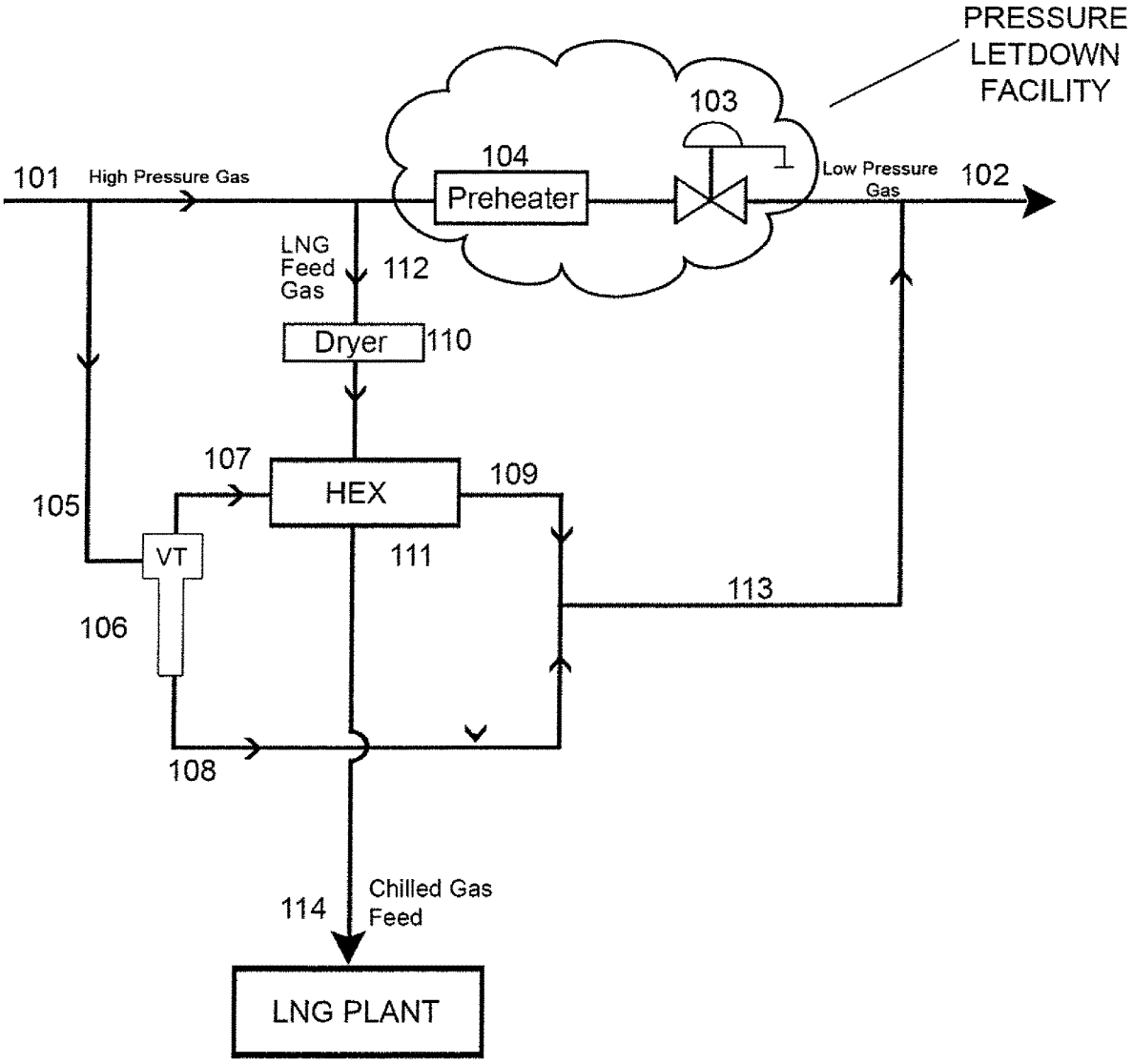
FIG. 2 is a preferred embodiment of the present invention using one Non-Freezing Vortex Tube and an indirect contact heat exchanger.

In a preferred embodiment of the present invention (see FIG. 2), the conversion of gas to liquid natural gas for storage and distribution is improved through additional free cooling. Specifically, a Non-Freezing Vortex Tube (106) ("VT"), with the designed capacity/flow rate substantially smaller than a letdown facility's main flow (101), however, greater than the LNG feed gas flow (112/114), The VT (106) via line 105 is connected to a high-pressure delivery line (101) upstream of a pipeline gas preheater (104) typically installed prior to a pressure regulation valve (103) ("PR"). The VT cold outlet (107), preferably 40% to 70% of the flow volume of the inlet VT flow (105), is connected to an indirect contact heat exchanger (111) ("HEX"). The VT cold outlet line (107) is recombined with the VT hot outlet (108) after the HEX's (111) exit (109) at line (113) which is fed to the low-pressure line (102) downstream of the letdown station's PR (103). Since the VT (106) outlet flow (113) is just a portion of the City Gate main flow, the VT (106) discharge pressure will always equalize with the City Gate discharge pressure (102).

A portion of high-pressure gas flow from upstream of the letdown station (112) is dried in a dryer (110) and is then directed to a HEX (111) to heat exchange with the VT cold outlet (107). The stream 114 out of the HEX (111) is high-pressure precooled liquid natural gas ("LNG") feed gas ready for liquefaction from a lower temperature than the prior art process.

This LNG feed gas (114) then proceeds to a turbo expander where the pressure is reduced, and the temperature dropped, followed by a refrigeration cold box system to further reduce temperature such that the LNG feed gas (114) becomes LNG. This process requires a great amount of energy and the less the temperature differential between the LNG plant inlet feed gas temperature (114) and −165° C. (the temperature that natural gas turns to a liquid), the less energy that is used. The present invention dramatically reduces that inlet gas temperature to provide significant benefit to the LNG plant without any external energy source at this LNG Feed Gas Precooling stage (via chiller, refrigerator, etc.). Instead, the cooling load applied to LNG feed gas via VT 106's cold outlet 107 and heat exchanger 111 is generated by the combined Joule-Thomson and Vortex physical phenomena which take place in the VT and put into practical application by the Non-freezing Vortex Tube disclosed in U.S. Pat. No. 5,749,231. See, FIG. 2.

The additional benefit of this preferred embodiment is the reduced energy consumption at the pipeline/wellhead pressure letdown facility in gas preheating, and reduced energy consumption in the refrigeration compressors used to bring the gas to cryogenic liquid phase. The VT (106) provided for non-freezing pressure regulation of a portion of the upstream gas (101) which otherwise would be treated in a preheater. Accordingly, there will be reduced carbon emissions in the operation of the refrigeration compressors because they will use less energy per ton of LNG produced, requiring less horsepower given the same output.

Figure 3:
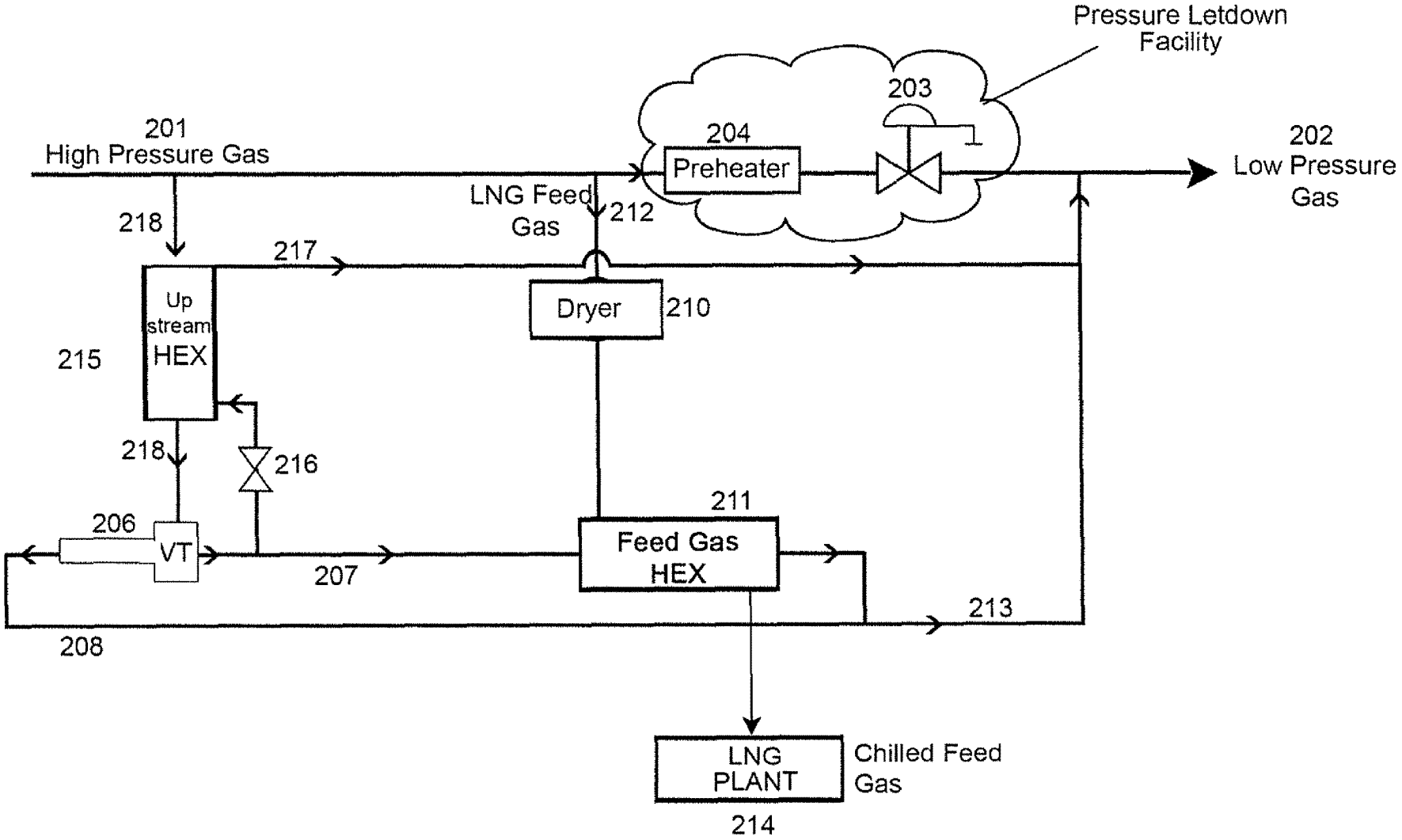
FIG. 3 is a preferred embodiment of the present invention using one Non-Freezing Vortex Tube and two indirect contact heat exchangers for a "two phase/stage" Vortex cooling.

In another preferred embodiment (shown in FIG. 3), the volumetric capacity of a VT (206), being substantially smaller than the City Gate/wellhead main flow line (201) is, nevertheless, large enough to apply the VT cold outlet (207)—preferably 40%-70% of the VT 208 inlet gas flow for direct LNG feed line (214) precooling as well as for the VT upstream gas line 218 precooling. The VT (206) through input flow line (218) is connected to a high-pressure delivery line (201) upstream of a pipeline gas Preheater (204) typically installed prior to a pressure regulation valve (203). The VT (206) cold flow output line (207) is directed to HEX (211) to precool the LNG feedline (214) as well as to the 1$^{st}$ stage/upstream HEX (215) to precool the VT (206) inlet gas flow (218). The VT (206) cold outlet (207) exiting HEX (211) is combined with the VT (206) hot outlet exit flow line (208) combining to form discharge line 213. The gas in discharge line (213) is joined with the gas leaving HEX (215) by gas flow line (217). The combined flow (line 213 and line 217) then are dumped into the low-pressure part of the pipeline (202). A portion of high-pressure gas flow (212) is dried in a dryer (210) and directed to HEX (211) to come out as the high pressure precooled LNG feed gas (214).

Figure 4:
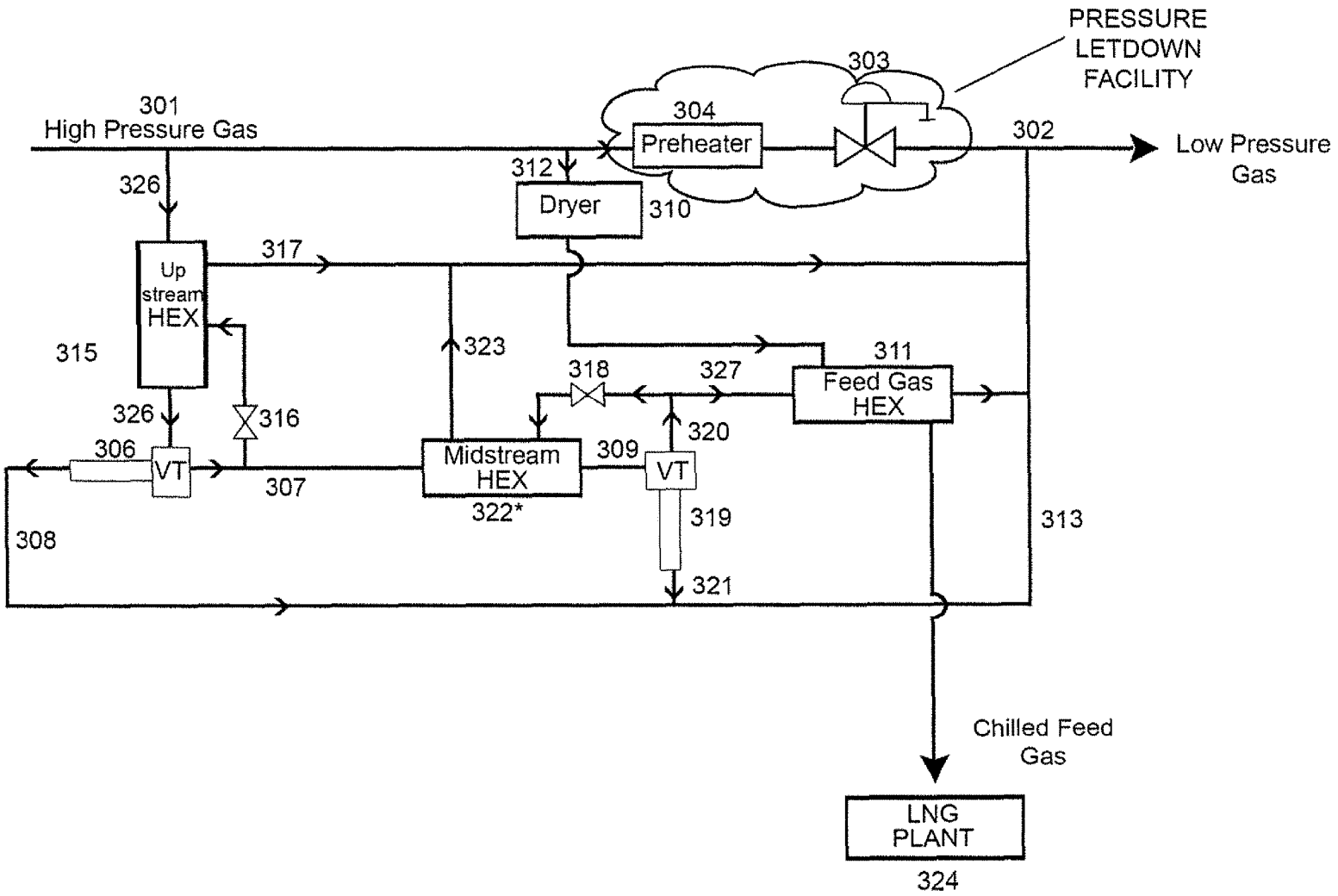
FIG. 4 is a preferred embodiment of the present invention using two Non-Freezing Vortex Tube and three indirect contact heat exchangers for a "three (or multi-) phase/stage" Vortex cooling.

Another preferred embodiment (shown in FIG. 4) of the present invention is a cascade Non-freezing Vortex Tube arrangement where multiple vortex tubes are arranged to maximize temperature drop in the vortex tube cold outlets. The cascade Non-Freezing Vortex Tube arrangement eliminates the limitation on the vortex temperature incremental "net" increase that takes place in a single Non-Freezing Vortex Tube upon its inlet to outlet gas pressure ratio increase. Thus, in case when a gas pressure ratio equal to or in excess of 5 is available at the letdown facility, two or more Non-Freezing Vortex Tubes operating in series (the cold outlet of an upstream VT performs as an inlet to the corresponding downstream VT) can be applied.

This preferred embodiment can be applied at a Letdown facility were the first VT (306) volumetric capacity is substantially smaller than the Letdown Facility main flow (301) capacity, but is large enough to apply the VT (306) cold outlet (307) (preferably, 40% to 70% of the VT 306 inlet flow) to efficiently precool its own upstream gas flow through HEX (315) as well as to feed the second VT (319). The second VT (319) volumetric capacity is also substantially smaller than the Let Down Facility main flow (301) capacity, but is large enough to apply the second VT (319) cold outlet (320) (preferably, 40% to 70% of the VT 319 inlet flow) to efficiently precool the direct LNG feed line as well as to efficiently precool the second VT (319) inlet gas in the intermediate HEX through valve (318). See, FIG. 4.

Specifically, a first stage/upstream VT (306) connected to a source of high-pressure gas (301) and operates at a gas pressure ratio no less than two to one from inlet to outlet pressure. The cold outlet (307) of this VT (306) is split in two parts. One part goes through valve (316) and is directed to the 1$^{st}$ stage/upstream HEX (315) where it cools the VT (306) inlet gas line and then transmits through line (317) from HEX 315 and is dumped into the downstream low-pressure pipeline gas line. The second part of the cold stream (307) is directed to the 2$^{nd}$ stage/midstream HEX (322) and into the second VT (319) that operates under a gas pressure ratio no less than two to one from inlet to outlet pressure. The cold gas 320 exiting the second VT (319) is divided into two parts. One part through the valve (318) is directed to the 2$^{nd}$ stage/midstream HEX (322) to cool down the inlet of the second VT (319). This gas flow (323)—after passing through the 2$^{nd}$ stage/midstream HEX and fulfilling its thermal duties—is joined with line 317 and further, combined with the gas in line 313 and discharged into the low-pressure pipeline gas line 302. The second part of second VT (319) cold gas flow (320) is directed to the Feed Gas/Downstream HEX (311) where it cools the LNG feed gas line. The hot gas discharge from VT (306) through line 308 and second VT (319) through line 321 are delivered to the low-pressure collector line (313) and dumped into the low-pressure gas line. The LNG feed gas line taken upstream of the gas preheater (304) in line 312 is dried in a dryer (310) and then directed to the Feed Gas HEX (311) to come out as the high pressure precooled LNG feed gas that is directed to a turbo expander and liquefaction cold box refrigeration system, producing the final product of liquid natural gas (LNG). See, FIG. 4.

Those of ordinary skill in the art will recognize that the embodiments just described merely illustrate the principles of the present invention. Many obvious modifications may be made thereto without departing from the spirit or scope of the invention as set forth in the appended claims.

What is claimed is:

1. A method for cooling a flow of natural gas feedstock supplying a conventional natural gas liquefication plant, the method comprising:

directing a first portion of a natural gas flow directed to a natural gas letdown facility to a first non-freezing vortex tube, wherein a first connection to the natural gas flow corresponding to the first portion is located upstream of the natural gas letdown facility;

connecting a cold outlet of the first non-freezing vortex tube to a coolant input of a feed gas heat exchanger;

directing a second portion of the natural gas flow sourced from upstream of the natural gas letdown facility from a second connection to a dryer, wherein the second connection is separate from the first connection;

cooling the second portion of the natural gas by flowing the second portion through the feed gas heat exchanger cooled by gas sourced from the cold outlet of the first non-freezing vortex tube;

directing the cooled second portion of natural gas flow from the feed gas heat exchanger to an expansion turbine and refrigeration cold box system for the production of liquid natural gas;

directing a coolant output of the feed gas heat exchanger to join with a hot outlet of the first non-freezing vortex tube to form a combined outlet gas flow; and directing the combined outlet gas flow to join a low-pressure natural gas flow downstream of the natural gas letdown facility.

2. The method of claim 1, where a first non-freezing vortex tube cold outlet flow volume is between 40%-70% of a first non-freezing vortex tube inlet flow volume.

3. The method of claim 1, further comprising: connecting the first portion of the natural gas flow to an upstream heat exchanger before directing the first portion of the natural gas flow to an inlet of the first non-freezing vortex tube;

connecting the cold outlet of the first non-freezing vortex tube to a coolant inlet of the upstream heat exchanger to precool the first non-freezing vortex tube inlet flow; and directing a coolant outlet of the upstream heat exchanger to combine with the combined outlet gas flow before directing the combined outlet gas flow to join the low-pressure natural gas flow downstream of the natural gas letdown facility.

4. The method of claim 3, further comprising:

connecting the cold outlet of the first non-freezing vortex tube to a midstream heat exchanger to be cooled;

connecting an outlet of the midstream heat exchanger to an input of a second non-freezing vortex tube;

directing a first portion of a cold outlet of the second non-freezing vortex tube into a coolant inlet of the midstream heat exchanger;

directing a second portion of the cold outlet of the second non-freezing vortex tube into the inlet of the feed gas heat exchanger to cool down the second portion of the cold outlet prior to directing the second portion to the natural gas liqueficaction plant; and directing a gas flow of a hot outlet of the second non-freezing vortex tube to join the combined outlet gas flow before the combined outlet gas flow joins a continuation of the low-pressure natural gas flow downstream of the pressure letdown facility.

5. The method of claim 4, wherein the second non-freezing vortex tube cold output flow is between 40%-70% of an inlet flow of the second non-freezing vortex tube.

6. The method of claim 4, wherein the second non-freezing vortex tube inlet to outlet pressure differential ratio is at least 2-to-1.

7. A method of pre-cooling natural gas for a liquid natural gas plant, comprising:

supplying natural gas to an inlet of a non-freezing vortex tube;

supplying a cooled natural gas flow from a cold outlet of the non-freezing vortex tube to a coolant inlet of a feed gas heat exchanger;

supplying an inlet of the feed gas heat exchanger with natural gas taken from a connection point upstream of a source of the natural gas supplied to the inlet of the non-freezing vortex tube;

cooling the natural gas in the feed gas heat exchanger using the cooled natural gas flow;

supplying the liquid natural gas plant with cooled natural gas from an outlet of the feed gas heat exchanger; and combining a hot natural gas flow from a hot outlet of the non-freezing vortex tube with a flow of natural gas from a coolant outlet of the feed gas heat exchanger to form a combined outlet gas flow.

8. The method of claim 7, further comprising drying the natural gas supplied to the inlet of the feed gas heat exchanger in a dryer before supplying the natural gas to the inlet of the feed gas heat exchanger.

9. The method of claim 7, wherein an outlet flow volume of the cold outlet of the non-freezing vortex tube is between 40% and 70% of an input flow volume of natural gas into the non-freezing vortex tube.

10. The method of claim 7, further comprising supplying the combined outlet gas flow to an output of a natural gas letdown facility.

11. The method of claim 7, further comprising:

cooling the natural gas supplied to the inlet of the non-freezing vortex tube by passing the natural gas through an upstream heat exchanger; and cooling the upstream heat exchanger by connecting a coolant inlet of the upstream heat exchanger to the cold outlet of the non-freezing vortex tube.

12. The method of claim 11, further comprising:

adding a flow of natural gas from a coolant outlet of the upstream heat exchanger to the combined outlet gas flow.

13. The method of claim 11, further comprising:

supplying the cooled natural gas from the non-freezing vortex tube to a midstream heat exchanger to further cool the cooled natural gas;

supplying the cooled natural gas from the midstream heat exchanger into an inlet of a second non-freezing vortex tube; and supplying the coolant inlet of the midstream heat exchanger with a flow of natural gas from a cold outlet of the second non-freezing vortex tube.

14. The method of claim 13, further comprising:

supplying the feed gas heat exchanger with cooled natural gas from an outlet of the midstream heat exchanger.

15. The method of claim 13, further comprising:

adding a flow of natural gas from a hot outlet of the second non-freezing vortex tube and from a coolant outlet of the midstream heat exchanger to the combined outlet gas flow.

16. The method of claim 13, wherein an outlet flow volume of the cold outlet of the second non-freezing vortex tube is between 40% and 70% of an input flow volume of natural gas into the second non-freezing vortex tube.

17. The method of claim 13 wherein the second non-freezing vortex tube inlet to outlet pressure differential ratio is at least 2-to-1.

* * * * *